United States Patent [19]

Gallegos del Bosque

[11] Patent Number: 4,606,321

[45] Date of Patent: Aug. 19, 1986

[54] CRANKCASE POSITIVE VENTILATION VALVE

[76] Inventor: Hector H. Gallegos del Bosque, Avenida Jose F. Ortiz No. 292, Colonia las Margaritas 27130, Torreon, Coahiula, Mexico

[21] Appl. No.: 697,228

[22] Filed: Feb. 1, 1985

[30] Foreign Application Priority Data

May 25, 1984 [MX] Mexico ..... 201454

[51] Int. Cl.[4] ..... F02M 25/00

[52] U.S. Cl. ..... 123/574; 123/572

[58] Field of Search ..... 123/574, 572, 573, 41.86

[56] References Cited

U.S. PATENT DOCUMENTS 4,210,113 7/1980 Heffernan ..... 123/574
4,291,660 9/1981 Molyneaux ..... 123/574
4,305,369 12/1981 Norman ..... 123/574
4,338,908 7/1982 Trong ..... 123/574

*Primary Examiner*—Magdalen Y. C. Greenlief
*Attorney, Agent, or Firm*—Kerkam, Stowell, Kondracki & Clarke

[57] ABSTRACT

An improved positive crankcase ventilation valve is provided which provides a closed ventilation system by drawing air from for example the air cleaner through the crankcase. The air is circulated through the engine and drawn out of the cylinder head cover by manifold vacuum then into the engine combustion chamber. The improvement includes adjustable means for regulating the amount of air removed from the crankcase and provides means whereby the valve is also connected to the engine distributor via the vacuum distributor regulator for control of the engine spark ignition timing.

2 Claims, 3 Drawing Figures

CRANKCASE POSITIVE VENTILATION VALVE

This invention relates to improvements in positive ventilation valve means for internal combustion engine crankcases and to such a valve having connection to a vacuum actuated timing advancing means of an engine distributor and connection to manifold vacuum below the carburetor of the engine.

BACKGROUND OF THE INVENTION

A fully closed crankcase ventilation system is installed on all modern vehicles having internal combustion engines. A positive crankcase ventilation valve (PCV) is installed for example on the cylinder head cover of the vehicle and an outlet from the valve is connected to manifold vacuum. A crankcase inlet hose is generally connected to the cylinder head cover from the vehicles air cleaner whereby air is circulated through the engine and drawn out of the cylinder head cover by manifold vacuum into the combustion chambers and expelled with the exhaust gas.

It is a principle object of the present invention to provide a valve that is adjustable and the adjustment regulates the proportion of air to crankcase gases which are drawn by manifold vacuum to the base of the carburetor.

It is also an object of the present invention to connect the low pressure side of the improved valve to the vacuum regulator on the distributor to regulate the firing time of the engine.

It is desirable to have the air-gas mixture in the engine cylinders to fire at maximum compression that is top dead center during the compression stroke. Since timing for ignition varies with the engine RPMs it is necessary to have automatic means to advance firing as engine speeds increase and to retard firing at low idle speeds. In general at low speeds firing occurs from about 4° to about 12° to top dead center and at high speeds the distributor is advanced to for example 30° to 40° earlier than top dead center.

BRIEF SUMMARY OF THE INVENTION

An improved adjustable positive crankcase ventilation valve comprising a valve body having an interior cavity. A valve seat is provided at one end of the cavity and a valve ball is freely mounted within the cavity and adapted to close and open the valve at the valve seat. There is also provided a valve adjusting pin threaded into the upstream end of the valve housing above the valve ball to regulate opening of the valve. A first tube connects the valve cavity upstream of the valve seat to a source of reduced pressure such as manifold pressure below the carburetor throat of an engine and there is a second tube connecting the valve cavity with a normal pressure zone wherein the normal pressure zone may be a firing advance system of an internal combustion engine.

BRIEF DESCRIPTION OF THE DRAWING

The invention will be more particularly described in reference to the accompanying drawings wherein.

DETAILED DESCRIPTION OF THE INVENTION

Figure 1:
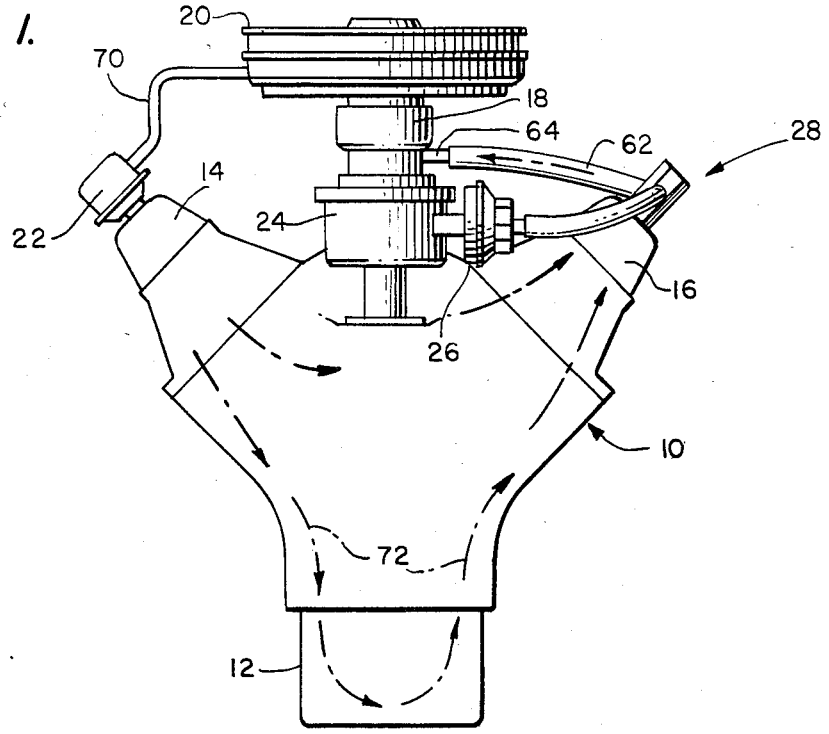
FIG. 1 diagramatically illustrates a V-type internal combustion engine fitted with the improved PCV valve of the invention.

Referring now to the drawing, 10 generally designates a V-type internal combustion engine having a crankcase 12, a pair of valve rocker arm head covers 14 and 16, a carburetor 18, an air cleaner 20, a crankcase inlet air cleaner 22, a distributor 24, vacuum timing, adjustment means for the distributor 26 and the improved PCV valve 28 of the invention. The distributor 24 is shown without a cap or distributor wires for clarity.

Figure 3:
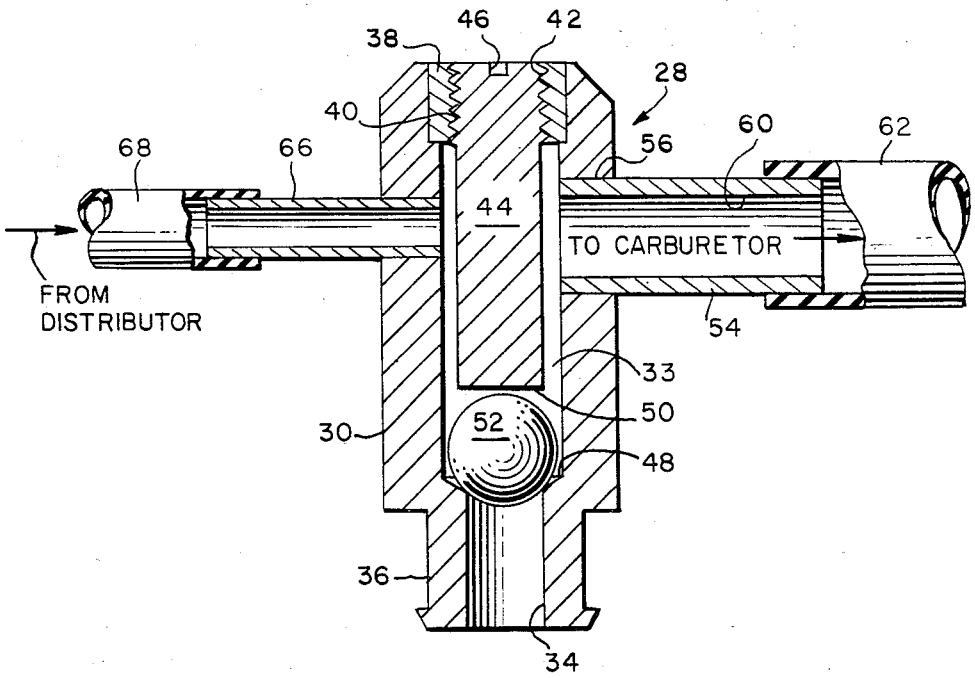
FIG. 3 is a vertical sectional view through the valve shown in FIG. 2.
Figure 2:
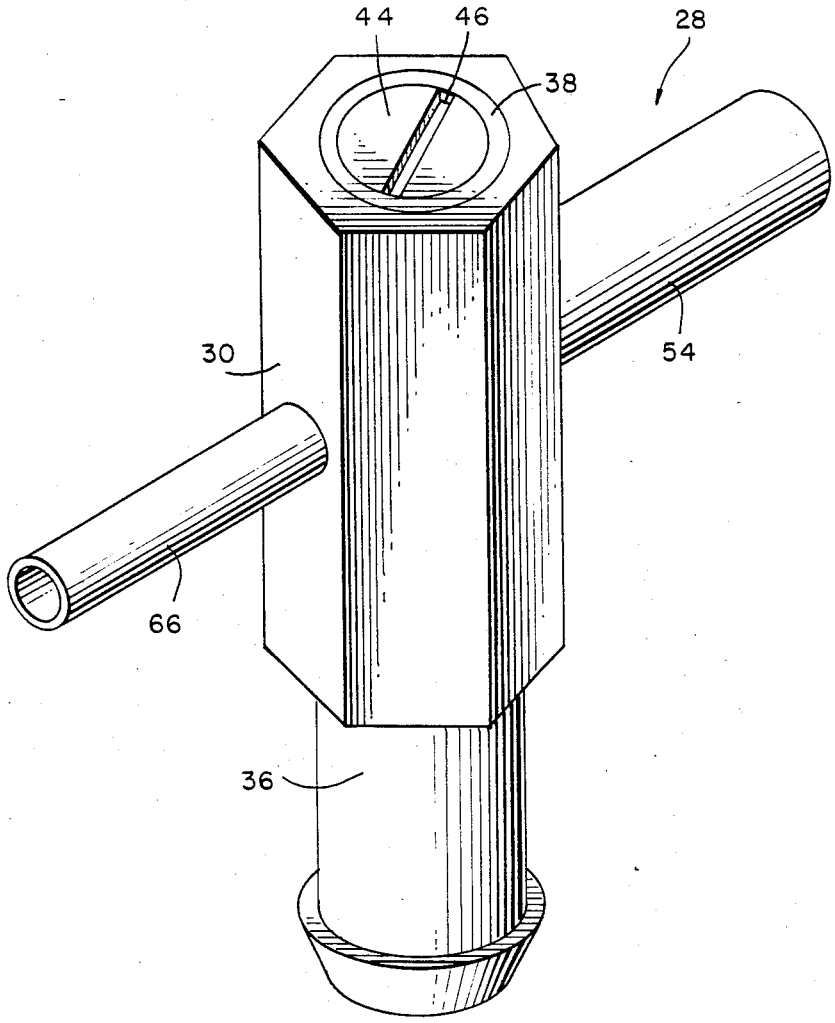
FIG. 2 is a perspective view of the improved valve of the invention.

Referring now more particularly to FIG. 3 the PCV valve 28 has a valve body 30 provided with an internal chamber 33 which communicates at end 34 with an opening and a conventional PCV valve fitting 36. The fitting 36 mounts the valve 28 on the head cover 16 in conventional manner. At the opposite end of the chamber 33 is a fitting 38 provided with internal threads 40 to receive external threads 42 of a valve stem 44. A screwdriver slot 46 may be provided in the top of the stem to permit ready adjustment of the height of the bottom 50 of the stem above valve seat 48. Below the bottom 50 of the stem 44 there is freely mounted a ball valve 52 which when the engine is not operating seats on the valve seat 48 as illustrated in FIG. 3.

The valve 28 includes a pipe 54 fitted to a bore 56 whereby the pipe communicates at one end with the valve chamber 33. End 60 of pipe 54 receives for example a rubber hose 62 which rubber hose connects to a pipe or nipple 64 leading into the carburetor below the carburetors choke in conventional manner.

The chamber 33 also communicates with a pipe or nipple 66 to which is attached a further or second rubber hose 68 which hose is connected to the vacuum regulator 26 of the distributor 24.

In conventional manner the crankcase inlet air cleaner 22 is connected by hose 70 via automobile engine air cleaner 20. Directional arrows 72 illustrate the flow of the air into and through the engine crank case and up through the PCV valve to the carburetor 10. The amount of air drawn from the head cover 16 containing fumes from the engine crankcase is readily adjusted by screwing the stem 44 inwardly or outwardly to permit lesser or greater movement of the ball 52 away from the seat 48 by vacuum from the engines manifold. Since the amount of air can be adjusted the air-fuel mixture in the cylinders at low RPMs and therefore low manifold pressure can be adjusted to prevent misfiring or bursts thereby saving on gasoline consumption. It will be further appreciated by those skilled in the art that at low manifold pressures the vacuum adjuster for the distributor 24 advances the firing of the engine and at high RPMs where the manifold pressure is greater and retards firing to bring about maximum efficiency in the engine.

I claim:

1. An improved adjustable positive crankcase ventilation valve comprising a valve body, and interior cavity in the valve body, a valve seat at one end of the cavity, a valve ball within the cavity adapted to close and open the valve at the valve seat, a valve adjusting pin, said adjusting pin positioned in said cavity and sized to permit passage of air thereabout, thread means mounting the adjusting pin above the valve ball to thereby regulate the opening and closing of the valve, a first tube connecting the valve cavity upstream of the valve seat and about the adjusting pin to a source of reduced pressure, and a second tube connecting the valve cavity upstream of the valve seat and about the adjusting pin with a normal pressure zone.

2. The invention defined in claim 1 wherein said second tube is connected to a firing advance system of an internal combustion engine.

* * * * *